US008375470B2

(12) United States Patent
Valentine

(10) Patent No.: US 8,375,470 B2
(45) Date of Patent: Feb. 19, 2013

(54) GARMENT WITH ADJUSTABLE WAISTBAND

(76) Inventor: Marie B. Valentine, Detroit, MI (US)

( * ) Notice: Subject to any disclaimer, the term of this patent is extended or adjusted under 35 U.S.C. 154(b) by 92 days.

(21) Appl. No.: 12/966,399

(22) Filed: Dec. 13, 2010

(65) Prior Publication Data

US 2012/0144560 A1 Jun. 14, 2012

(51) Int. Cl.
*A41D 1/14* (2006.01)
*A41D 1/06* (2006.01)
*A41F 9/00* (2006.01)

(52) U.S. Cl. ..... 2/221; 2/237; 2/76

(58) Field of Classification Search ..... 2/76, 219, 2/220, 221, 227, 235, 236, 237, 239, 240, 2/242, 338, 405, 408, 409
See application file for complete search history.

(56) References Cited

U.S. PATENT DOCUMENTS

| | | | | | |
|---|---|---|---|---|---|
| 280,444 | A | * | 7/1883 | Bush | 2/237 |
| 666,246 | A | * | 1/1901 | Henderson | 2/237 |
| 850,264 | A | * | 4/1907 | Sorensen | 2/221 |
| 912,642 | A | * | 2/1909 | Baker | 2/237 |
| 1,000,155 | A | * | 8/1911 | Dietz | 2/219 |
| 1,071,353 | A | * | 8/1913 | Schneider | 2/400 |
| 1,861,383 | A | * | 5/1932 | Ficcio | 2/227 |
| 2,113,732 | A | * | 4/1938 | Koppel | 2/227 |
| 2,335,971 | A | * | 12/1943 | Scholle | 2/221 |
| 2,423,666 | A | * | 7/1947 | Tennens | 2/221 |
| 3,089,149 | A | * | 5/1963 | Kelleam | 2/221 |
| 3,091,772 | A | * | 6/1963 | Hebras | 2/221 |
| 3,204,253 | A | * | 9/1965 | Sato | 2/237 |
| 3,362,029 | A | | 1/1968 | Comerma | |
| 3,793,645 | A | * | 2/1974 | Kadison | 2/221 |
| 3,823,419 | A | * | 7/1974 | Breitbart | 2/227 |
| 4,068,321 | A | | 1/1978 | Chayer | |
| 4,259,750 | A | * | 4/1981 | Barna | 2/234 |
| 4,424,596 | A | * | 1/1984 | Jackson | 2/240 |
| 4,580,298 | A | * | 4/1986 | Tuisl | 2/237 |
| 4,596,055 | A | * | 6/1986 | Aach et al. | 2/237 |
| 4,803,740 | A | | 2/1989 | Dawson | |
| 5,163,184 | A | | 11/1992 | Reardon | |
| 5,946,730 | A | * | 9/1999 | Blair | 2/227 |
| 6,085,356 | A | * | 7/2000 | Redmond, Sr. | 2/237 |
| 6,219,848 | B1 | | 4/2001 | Russell | |
| 6,367,086 | B1 | * | 4/2002 | Woodard | 2/237 |
| 6,385,777 | B1 | * | 5/2002 | Hamada et al. | 2/221 |
| D503,508 | S | | 4/2005 | Hooker et al. | |

(Continued)

FOREIGN PATENT DOCUMENTS

DE 3411183 A1 * 10/1985

*Primary Examiner* — Shelley Self
*Assistant Examiner* — Jane Yoon
(74) *Attorney, Agent, or Firm* — Dale J. Ream

(57) ABSTRACT

A garment with an adjustable waistband and modesty flap includes a garment material having a waistband that originates and terminates at a closable seam, the seam having opposed edges extending downwardly from the waistband that define a V-shaped open configuration when the edges are spaced apart from one another and a closed configuration when the edges are adjacent one another. A waistband extension member extends from a waistband terminal end. A plurality of waistband fasteners are spaced apart along a waistband outer surface, each waistband fastener having a configuration complementary a waistband coupling member for selective attachment thereto. A modesty flap is attached to the garment generally adjacent one seam opposed edge and configured to extend across the seam open configuration. A plurality of flap fasteners are spaced apart along the waistband inner surface, each flap fastener having a configuration complementary to a flap coupling member for selective attachment thereto.

9 Claims, 10 Drawing Sheets

U.S. PATENT DOCUMENTS

| | | | | |
|---|---|---|---|---|
| 7,516,499 | B2 * | 4/2009 | Gardner, III | 2/221 |
| D619,780 | S * | 7/2010 | Hooker et al. | D2/627 |
| 7,908,677 | B1 * | 3/2011 | Montgomery | 2/338 |
| 2007/0028364 | A1 * | 2/2007 | Oomae | 2/237 |
| 2007/0261150 | A1 * | 11/2007 | Oomae | 2/221 |
| 2010/0162467 | A1 * | 7/2010 | Rondon et al. | 2/227 |
| 2010/0235965 | A1 * | 9/2010 | Frandsen et al. | 2/237 |
| 2011/0010824 | A1 * | 1/2011 | Oomae | 2/221 |
| 2011/0072559 | A1 * | 3/2011 | Middleton | 2/311 |

* cited by examiner

GARMENT WITH ADJUSTABLE WAISTBAND

BACKGROUND OF THE INVENTION

This invention relates generally to garments with adjustable waistbands and, more particularly, to a garment with an adjustable waistband and with an adjustable modesty panel that covers an exposed area that is formed when the waistband is extended.

Tight waistbands on garments such as pantyhose cause uncomfortable constriction around the waist of a wearer. Pregnant or plus-size women often find wearing traditional pantyhose undesirable or even unbearable due to a tight waistband. Especially in the case of pregnancy, a woman may have to purchase multiple sizes of pantyhose to wear as her waist size naturally increases in circumference during the pregnancy.

Various devices for adjusting the size of a garment's waistband have been proposed in the prior art. Typically, adjustable waistbands have been proposed for garments such as pants or jeans—garments characterized by a separable center seam that extends downwardly from the waistband. As the waistband is lengthened, the center seam spreads apart and forms an opening that exposes the wearer's skin. In an effort to solve the exposed area issue, it has been proposed to fasten a flap of material inside the garment to cover the exposed area opening. These proposals are shown in U.S. Pat. Nos. 5,163,184 and 4,803,740. Although assumably effective for their intended purposes, the existing proposals typically result in the cover flap becoming bunched up inside the garment, especially when the waistband is tightened and the cover flap is not fully spread out.

Therefore, it would be desirable to have a garment, such as pantyhose, having an easily length adjustable waistband to enable a user to relieve the discomfort caused by traditional pantyhose. Further, it would be desirable to have a garment having a central seam that separates as the waistband is expanded so as to properly proportion the garment to a user's form. In addition, it would be desirable to have a garment having a modesty flap that is also adjustable such that it does not become bunched up as the waistband is adjusted.

SUMMARY OF THE INVENTION

A garment with an adjustable waistband and modesty flap includes a garment material having a waistband that originates and terminates at a closable seam, the seam having opposed edges extending downwardly from the waistband that define a V-shaped open configuration when the edges are spaced apart from one another and a closed configuration when the edges are adjacent one another. A waistband extension member extends from a waistband terminal end. The waistband includes an inner waistband surface positioned against a user and an outer waistband surface opposite the inner surface. A plurality of waistband fasteners are spaced apart along the waistband outer surface, each waistband fastener having a configuration complementary to the waistband coupling member for selective attachment thereto. A modesty flap is attached to the garment material inner surface generally adjacent one seam opposed edge and configured to extend across the seam open configuration toward another seam opposed edge. A plurality of flap fasteners are spaced apart along the waistband inner surface, each flap fastener having a configuration complementary to the flap coupling member for selective attachment thereto.

Therefore, a general object of this invention is to provide a garment, such as pantyhose, having an adjustable waistband and a modesty panel to cover an exposed area that is created when the waistband is lengthened.

Another object of this invention is to provide a garment, as aforesaid, having a seam that opens when the adjustable waistband is lengthened and closes when the waistband is tightened.

Still another object of this invention is to provide a garment having multiple waistband fasteners, as aforesaid, that enable a user to choose the length of the waistband.

Yet another object of this invention is to provide a garment, as aforesaid, having multiple modesty panel fasteners that enable a user to selectively choose the position of the panel such that it does not bunch up inside the garment.

A further object of this invention is to provide a garment, as aforesaid, in which a crotch and foot portions are reinforced with padding.

A still further object of this invention is to provide a garment, as aforesaid, in which the waistband and modesty panel are easy and quick to adjust and position.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
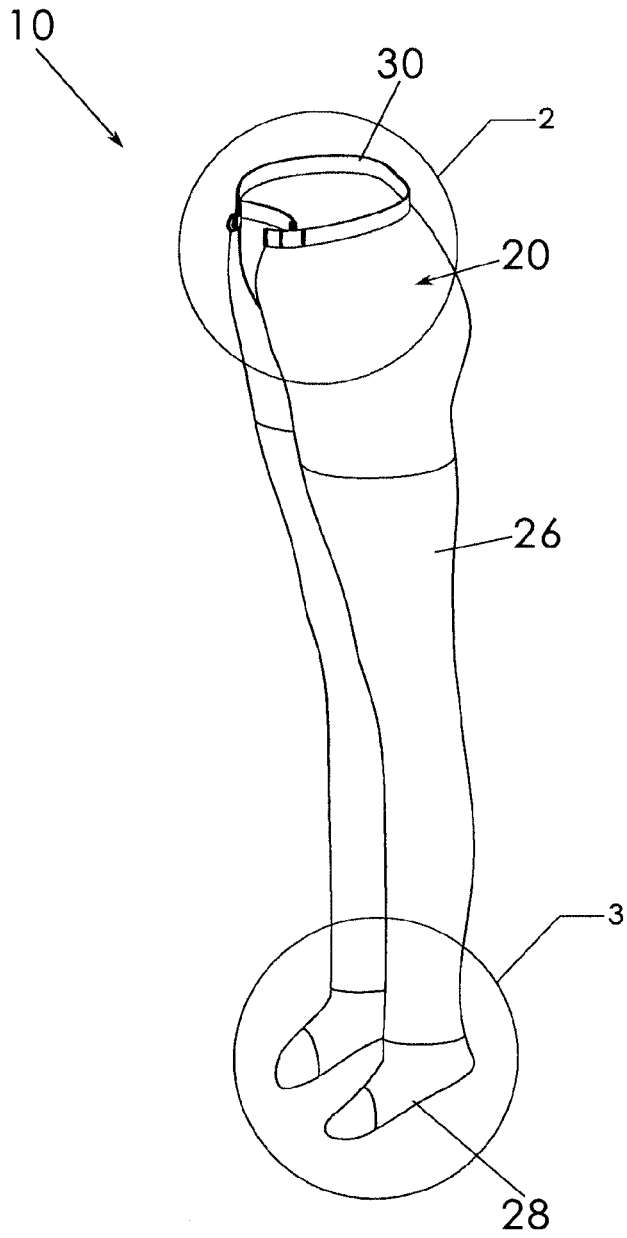
FIG. 1 is a perspective view of a garment with an adjustable waistband and adjustable modesty flap according to a preferred embodiment of the present invention.

A garment having an independently adjustable waistband and modesty panel will now be described in detail with reference to FIGS. 1 to 10 of the accompanying drawings. The garment 10 includes a waist portion 20, a pair of leg portions 26 extending downwardly from the waist portion 20, and a waistband 30 extending about an upper edge of the waist portion 20. The garment 10 also includes a modesty flap 60 configured to cover an exposed area of a user's skin when the waistband 30 is expanded, as will be described below. Although the preferred embodiment described below relates specifically to pantyhose, it is understood that other garments having a waist band may also be constructed using the principles of the present invention, such as pants, jeans, or the like.

The waist portion 20 of the garment 10 refers to a material construction configured to be worn about the hip region of a person. The waist portion 20 includes inner 22 and outer 24 surfaces. The leg portions 26 are configured to receive a person's legs, respectively, the leg portions joining together at a lower end of the waist portion 20 to form a crotch area 29. In the embodiment of pantyhose, a foot portion 28 is connected to a lower end of each leg portion 26. Preferably, the crotch 29 and foot portions 28 each include reinforced material and padding to enhance the durability of the garment, those portions being areas that receive the most wear and tear.

Figure 9:
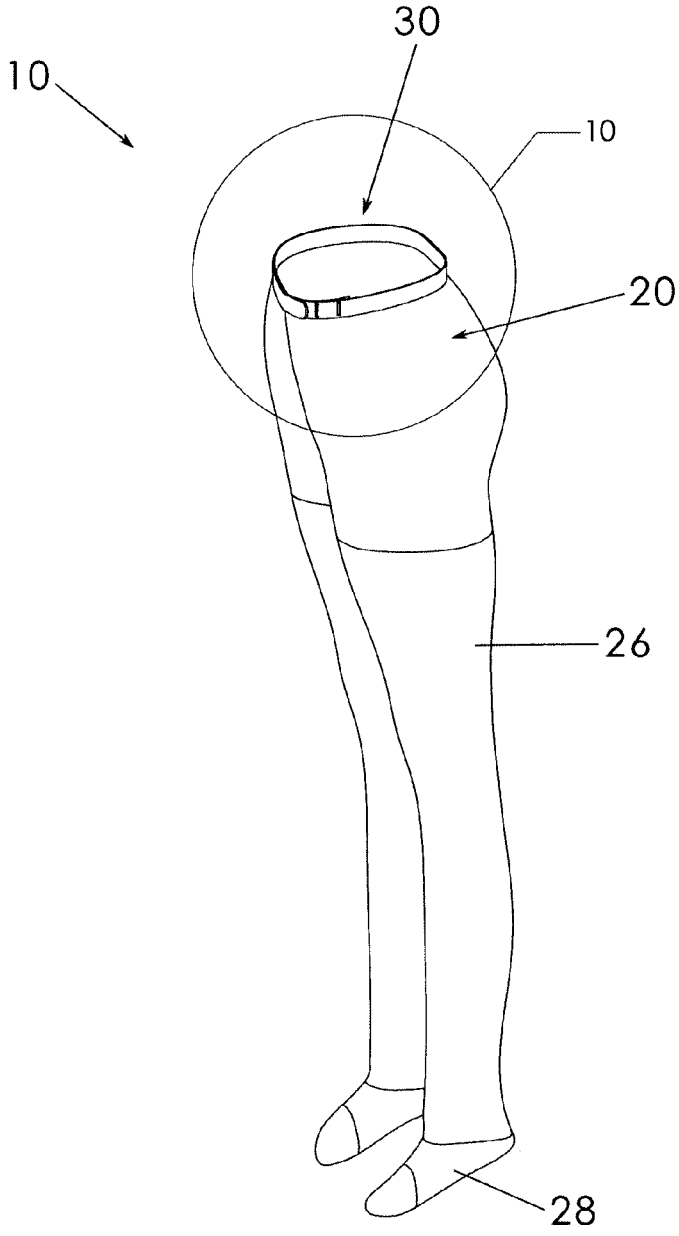
FIG. 9 is a perspective view of the garment with the closable seam at a closed configuration.
Figure 10:
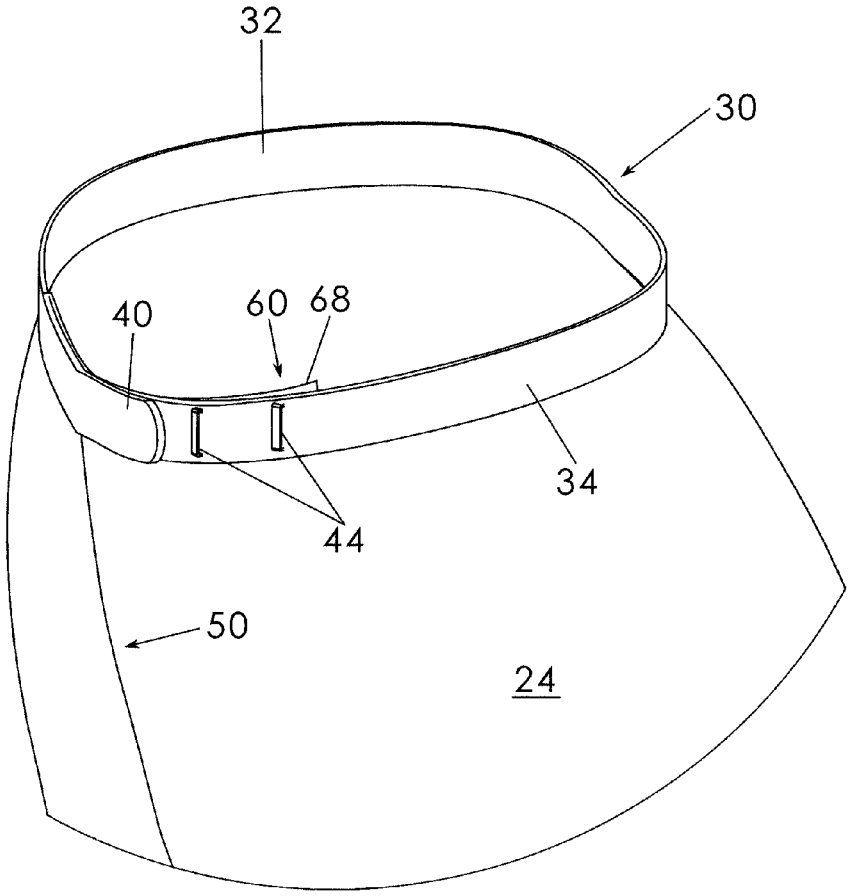
FIG. 10 is an isolated view on an enlarged scale taken from a portion of FIG. 9.

The waistband 30 is connected to an upper end of the waist portion 20 and originates and terminates at a closable seam 50. The closable seam 50 includes opposed edges 52 that extend downwardly from opposed origination 36 and terminal 38 ends of the waistband 30 and converge adjacent the garment crotch 29. The closable seam 50 is movable between an open configuration in which the opposed edges are separated from one another so as to form an open or exposed area (FIG. 7) and a closed configuration in which the opposed edges of the seam 50 are immediately adjacent one another (FIGS. 9 and 10). In other words, when the seam is open, the garment defines an open area that would expose the skin of a wearer of the garment. The waistband 30 includes an inner surface 32 that is positioned against a person when the garment 10 is worn and an outer surface 34 opposite the inner surface 32.

Figure 5:
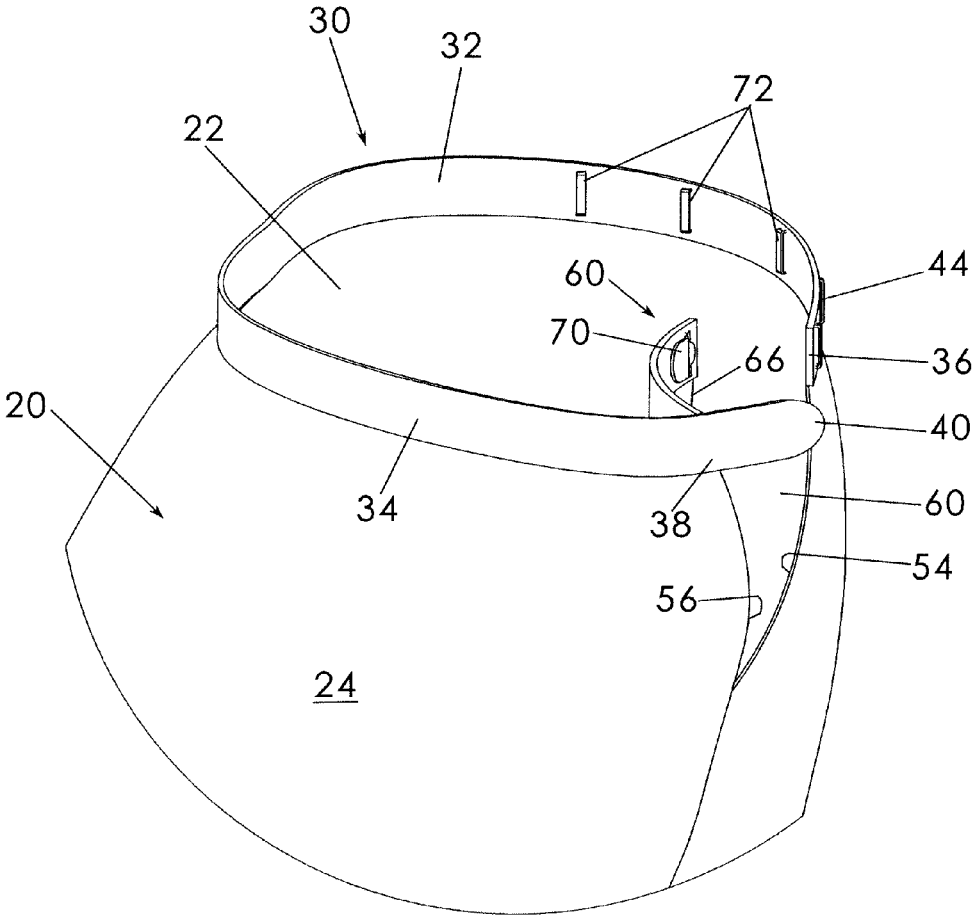
FIG. 5 is an isolated view on an enlarged view taken from a portion of FIG. 4.
Figure 6:
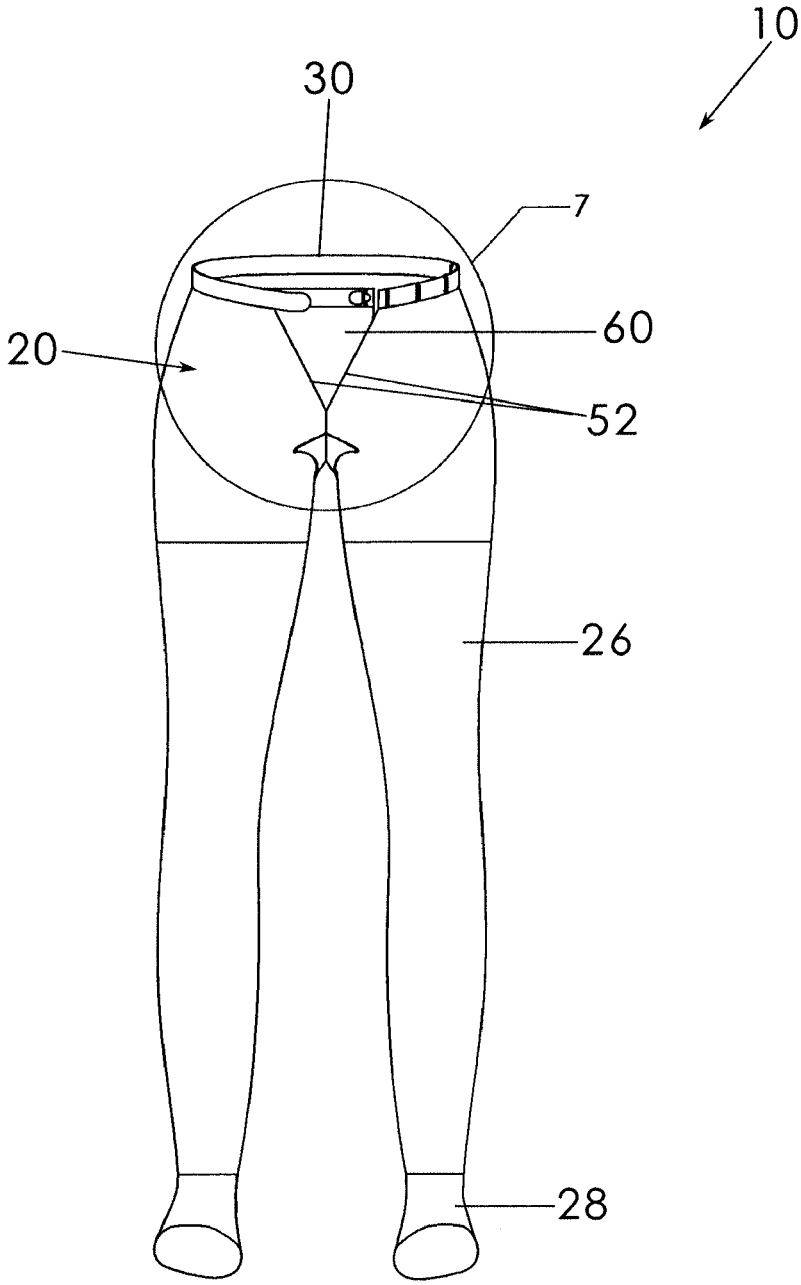
FIG. 6 is a front view of the garment as in FIG. 1.
Figure 7:
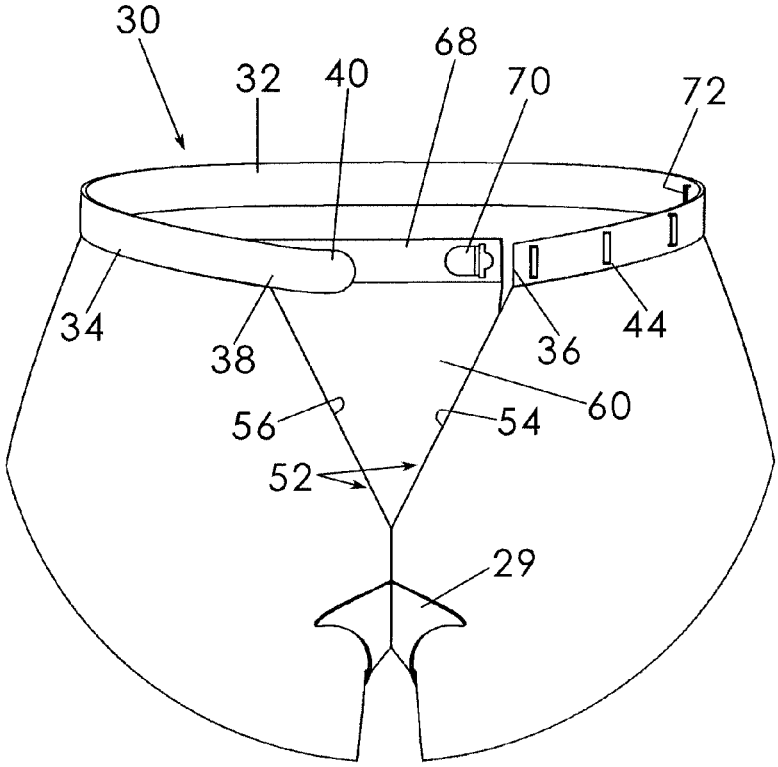
FIG. 7 is an isolated view on an enlarged scale taken from a portion of FIG. 6.
Figure 8:
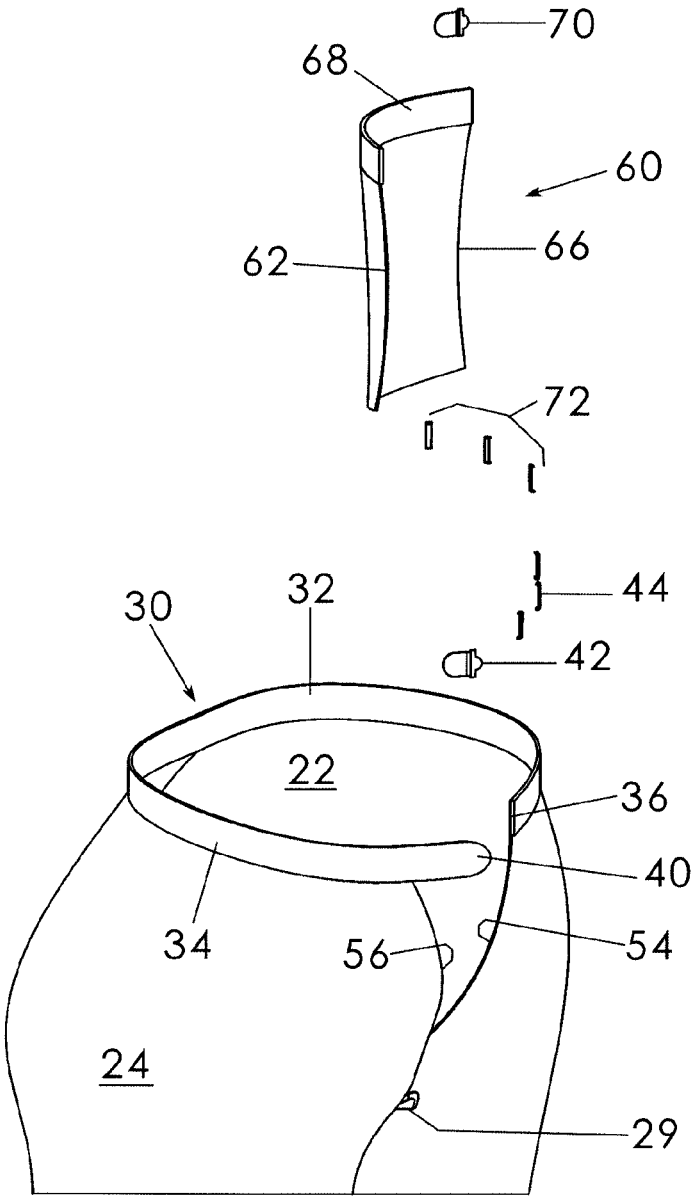
FIG. 8 is an exploded view of the garment as in FIG. 5.

The waistband 30 includes an origination end 36 adjacent a first 54 of the opposed edges 52 of the seam 50 and a terminal end 38 adjacent a second 56 of the opposed edges 52 (FIG. 5). More particularly, the terminal end 38 of the waistband 30 includes a waistband extension member 40 that extends outwardly beyond the respective seam edge so that it extends across the seam 50. A waistband coupling member 42 is fixedly attached to an inner surface of the extension member 40 adjacent a terminal end thereof for selectively coupling the extension member 40 to the outer surface 34 of the waistband 30, as will be described in greater detail below.

Figure 2:
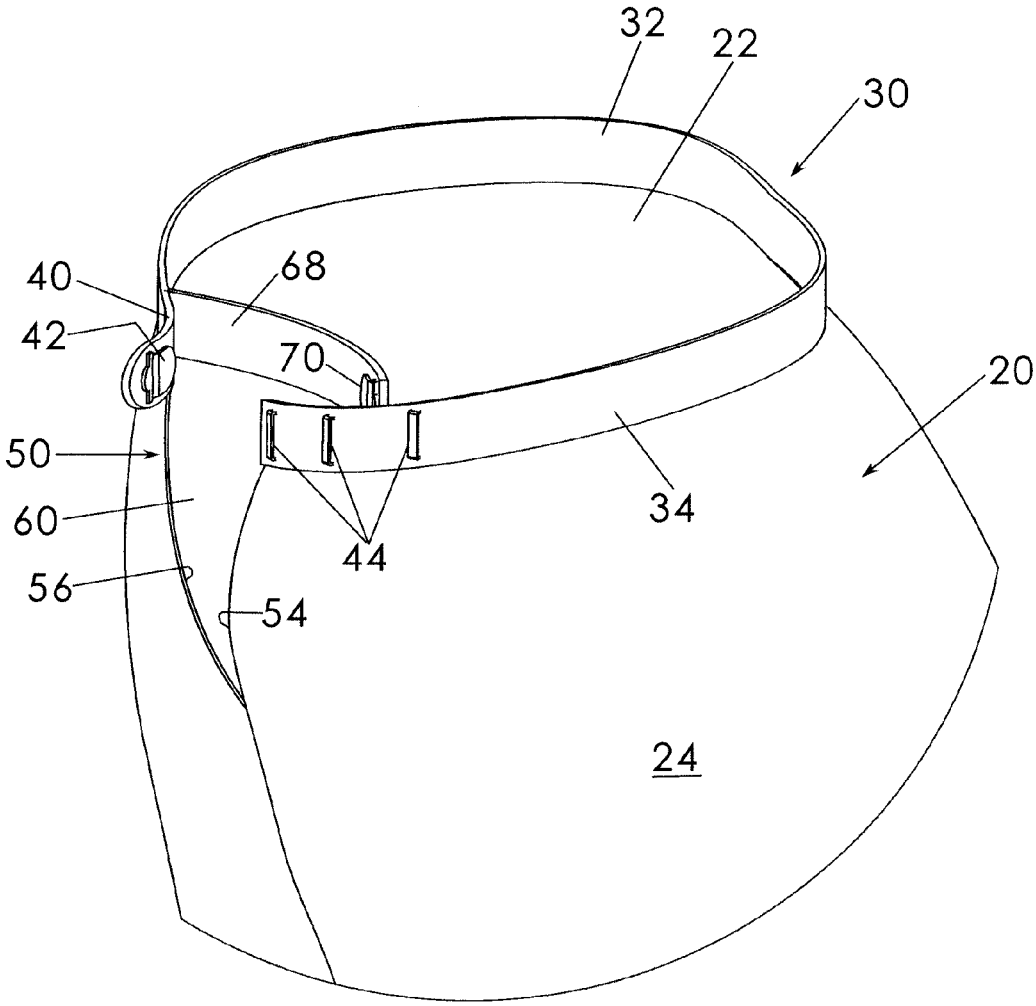
FIG. 2 is an isolated view on an enlarged view taken from a portion of FIG. 1.
Figure 3:
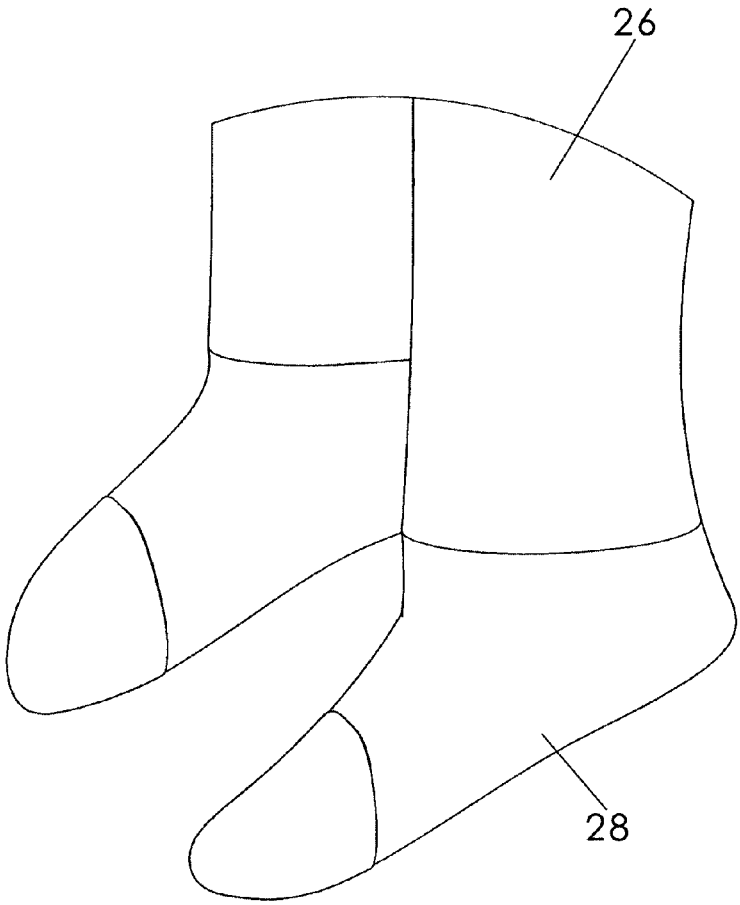
FIG. 3 is an another isolated view on an enlarged view taken from a portion of FIG. 1.
Figure 4:
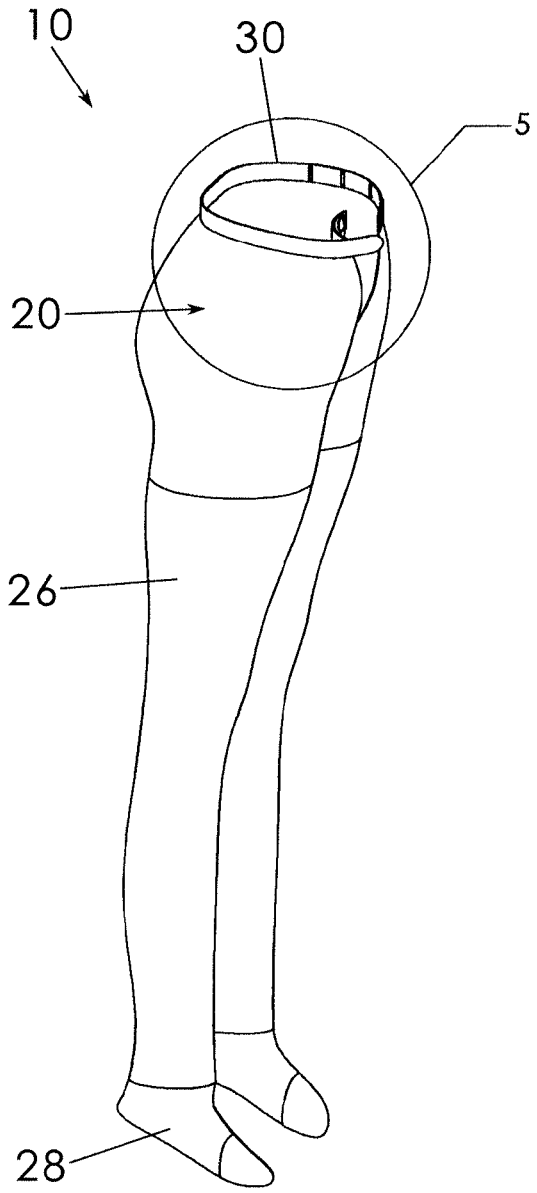
FIG. 4 is a perspective view of the garment as in FIG. 1 taken from another angle.

The garment 10 includes a plurality of waistband fasteners 44 attached to the waistband outer surface 34 and spaced apart from one another. The waistband fasteners 44 are preferably positioned adjacent the origination end 36 of the waistband (FIG. 2). The waistband fasteners 44 may be trouser buckles, hook and loop fasteners, buttons, latches, clasps, or the like. Each waistband fastener 44 includes a configuration that is complementary to the waistband coupling member 42 such that the waistband coupling member 42 may be selectively and removably coupled to a selected waistband fastener 44. The waistband 30 is effectively loosened or lengthened when the waistband coupling member 42 is coupled to a waistband fastener 44 closer to the waistband origination end 36 and tightened when the waistband coupling member 42 is coupled to a waistband fastener 44 spaced away from the waistband origination end 36 in a manner similar to operation of a belt.

The garment modesty flap 60 includes a cloth construction having a generally rectangular construction although other configurations may also work. The modesty flap 60 may have a proximal edge 62 fixedly connected to the inner surface of the waist portion 22 adjacent the second edge 56 of the seam 50. The modesty flap 60 then extends across the opening defined by the seam when the edges thereof are separated and terminates at a free edge 66. The modesty flap 60 includes an upper segment 68 and a flap coupling member 70 is attached to the flap upper segment 68 adjacent the free edge 66 thereof. A plurality of flap fasteners 72 are spaced apart along the waistband inner surface 32, each flap fastener 72 having a configuration that is complementary to the flap coupling member 70 for selective attachment thereto. As the waistband 30 is tightened as described above, the modesty flap 60 may also be adjusted such that the material does not become bunched up. More particularly, the flap coupling member 70 may be selectively and releasably coupled to a corresponding flap fastener 72 that allows the flap 60 to maintain a completely flattened configuration that is not bunched up, even when the waistband 30 is positioned at a tightened configuration. When positioned as described above, the modesty flap 60 is always positioned to completely block/cover the skin of a user that would otherwise be exposed when the seam edges are separated—such as when the waistband 30 is lengthened and the closable seam gaps open.

In use, a user may wear the garment 10 described above by inserting her legs through the open top of the waist portion 20 and into the leg portions 26. In other words, the garment 10 may be worn in the traditional manner of pantyhose. The waistband 30 of the garment 10 may be length adjusted as described above. Namely, the waistband extension member 40 may be pulled across the opening that is naturally created by the closable seam 50 when the garment 10 is first put on by a user and then the waistband coupling member 42 may be coupled to a desired waistband fastener 44. The modesty flap 60 may also be positioned as desired as described above. Specifically, the modesty flap coupling member 70 may be independently coupled to an appropriate modesty flap fastener 72 corresponding to the waistband fastener 44 having been selected such that the modesty flap 60 maintains a flat configuration that is not bunched up.

It is understood that while certain forms of this invention have been illustrated and described, it is not limited thereto except insofar as such limitations are included in the following claims and allowable functional equivalents thereof.

The invention claimed is:

1. A garment having an adjustable waistband and adjustable modesty flap, comprising:

a garment material having a waist portion and a pair of leg portions extending downwardly from said waist portion, said garment material having inner and outer surfaces;

a waistband situated at an upper end of said waist portion that originates and terminates at a closable seam, said seam having opposed separable edges extending downwardly from said waistband that selectively define a generally V-shaped open configuration when said edges are spaced apart from one another and a generally closed configuration when said edges are adjacent one another;

a waistband extension member extending outwardly from a waistband terminal end and extending across said seam, said extension member having a waistband coupling member at a terminal end thereof;

wherein said waistband includes an inner waistband surface positioned against a user and an outer waistband surface opposite said inner waistband surface;

a plurality of waistband fasteners spaced apart along said outer waistband surface, each waistband fastener having a configuration complementary to said waistband coupling member for selective attachment thereto;

a modesty flap having a proximal edge fixedly connected to said inner surface of said waist portion adjacent a first edge of said seam, said modesty flap having a free edge opposite said modesty flap proximal edge and having an upper segment;

a flap coupling member attached to said modesty flap upper segment adjacent said free edge thereof; and a plurality of modesty flap fasteners positioned on said inner waistband surface and spaced apart therealong, each flap fastener having a configuration complementary to said flap coupling member for selective attachment thereto.

2. The garment as in claim 1, wherein said seam is moved between said open and closed configurations when said waistband extension member is coupled to respective waistband fasteners.

3. The garment as in claim 1, wherein said plurality of waistband fasteners are selected from the group comprising trouser hooks, hook and loop fasteners, buttons, latches, and clasps.

4. The garment as in claim 2, wherein said modesty flap includes a configuration that completely blocks a user's skin from being exposed to view when said seam is at said open configuration.

5. The garment as in claim 1, wherein said plurality of waistband fasteners are positioned on an opposite surface of said waistband with respect to said plurality of modesty flap fasteners.

6. The garment as in claim 1, further comprising a crotch portion situated between said pair of leg portions, said crotch including padding.

7. The garment as in claim 6, further comprising a pair of foot portions, each foot portion being connected to a respective leg portion in a unitary construction and having a padded construction.

8. The garment as in claim 1 further comprising a pair of foot portions, each foot portion being connected to a respective leg portion and having a padded construction.

9. The garment as in claim 1, wherein:

said modesty flap includes a rectangular configuration; and said modesty flap is not bunched up when said seam is at said closed configuration.

* * * * *